United States Patent [19]

Peterson

[11] Patent Number: 4,861,040

[45] Date of Patent: Aug. 29, 1989

[54] MULTI-LEVEL BOARD GAME

[76] Inventor: Jeffrey D. Peterson, 912 Noyes St., Apt. H, Evanston, Ill. 60201

[21] Appl. No.: 241,457

[22] Filed: Sep. 8, 1988

[51] Int. Cl.[4] ..... A63F 3/00

[52] U.S. Cl. ..... 273/241; 273/255; 273/287

[58] Field of Search ..... 273/241, 255, 262, 287

[56] References Cited

U.S. PATENT DOCUMENTS

| | | | |
|---|---|---|---|
| 2,757,933 | 8/1956 | Gilmour | 273/287 |
| 3,692,310 | 9/1972 | Martin | 273/241 |
| 3,811,679 | 5/1974 | Benge | 273/258 |
| 4,062,545 | 12/1977 | Witney | 273/239 |
| 4,205,851 | 6/1980 | Hopkins | 273/241 |
| 4,333,655 | 6/1982 | Rudell | 273/241 |
| 4,373,731 | 2/1983 | Whiteman et al. | 273/262 |
| 4,415,160 | 11/1983 | Lamb | 273/255 |
| 4,541,635 | 9/1985 | Shaptaugh | 273/284 |

FOREIGN PATENT DOCUMENTS

| | | | |
|---|---|---|---|
| 0224381 | 6/1987 | European Pat. Off. | 273/262 |
| 1400205 | 7/1975 | United Kingdom | 273/255 |

*Primary Examiner*—Edward M. Coven
*Assistant Examiner*—Benjamin Layno
*Attorney, Agent, or Firm*—Leon Gilden

[57] ABSTRACT

A multi-level board game is set forth wherein a pair of players each are protective of their individual castle or "Keep". Each player is provided with a plurality of tokens representing Vassals, a Wizard, a plurality of Archers, and an Earthstone. The object of the game is to travel the board game from a player's Home Keep to an opposing player's Keep or to alternatively remove the opponents players, overpower the opponents Earthstone, or move the Demon player to overtake an opponent's Earthstone. The players are moved by a predetermined orientation relative to each other or alternatively may use pyramidal dice to determine the number and type of movement employed. Each player's Wizard and three Archers have powers to destroy opponents during the course of the game.

7 Claims, 4 Drawing Sheets

MULTI-LEVEL BOARD GAME

BACKGROUND OF THE INVENTION

1. Field of the Invention

The field of invention relates to board games, and more particularly pertains to a new and improved novel board game that employs mythological characters to develop imagination among participants of the game and to entertain the same.

2. Description of the Prior Art

The playing of board games in various forms is well known in the prior art. Furthermore, games that simulate combat among participants is developed in various other games, such as may be found in U.S. Pat. No. 3,811,679 to Benge wherein a game board is provided with a plurality of pieces movable thereon including sections of land and bodies of water. The pieces are divided into land pieces and water pieces of different categories each that are provided with various capacities in the playing of the game. The game is terminated when the pieces assigned to a capital of an opponent is occupied by an adversary.

U.S. Pat. No. 4,062,545 to Witney sets forth a downhill racing game provided with a playing board with a multi-dimensional upper portion with a ski route having a plurality of paths. A pair of dice are provided, as well as chance card for determining the number of squares to move along the various paths, including mishap cards that are employed to add an element of chance during playing of the game.

U.S. Pat. No. 4,205,851 to Hopkins sets forth a board game wherein the board game is divided into a plurality of sections with flexible hinges therebetween including an elevational portion to provide a multi-level board game divided into a plurality of sections.

U.S. Pat. No. 4,333,655 to Rudell sets forth a board game with a vertical surface secured to a horizontal surface wherein the vertical surface is representative of a mountain including trails and paths and employing missiles, and the like which are to simulate hazards associated with the game during its playing.

U.S. Pat. No. 4,541,635 to Shoptaugh sets forth a game board structure including a plurality of playing pieces in which the playing pieces are movable relative to a given axis of a plurality of elongated rectilinear sliders mounted thereon for movement in side to side relationship relative to each other along the given axes. The game board is further provided with an improved detente structure for restraining the sliders in predetermined position during movement. The game board of Shoptaugh is of interest relative to a unique game board structure and related movement of playing pieces thereon.

As such, it may be appreciated that the instant invention sets forth an improved earthstone board game that combines various features of chance, warfare, strategy, and imagination and this respect, the present invention satisfies needs in the prior art in this area.

SUMMARY OF THE INVENTION

In view of the foregoing disadvantages inherent in the known types of board games now present in the prior art, the present invention provides an earthstone board game wherein a multi-level board game surface simulates geographical topography to enhance the playing of a game comprising opposing sides utilizing characteristics of the occult, warfare, and prized territories and possessions. As such, the general purpose of the present invention, which will be described subsequently in greater detail, is to provide a new and improved earthstone board game which has all the advantages of the prior art board games and none of the disadvantages.

To attain this, the present invention sets forth an earthstone board game wherein aspects of the mystical and occult, as well as the challenging aspects of combat, are utilized to challenge the imagination and sharpen the wits of participants. A multi-level board game surface is utilized to simulate topographical variances in a land based combat situation employing Archers, Vassals, as well as a Wizard and a Demon to conquer an opposing participant's castle or "Keep". A valued "Earthstone" is provided each player to simulate a valued object to avoid falling into an opponent's hands.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved earthstone board games which has all the advantages of the prior art board games and none of the disadvantages.

It is another object of the present invention to provide a new and improved earthstone board game which may be easily and efficiently manufactured and marketed.

It is a further object of the present invention to provide a new and improved earthstone board game which is of a durable and reliable construction.

An even further object of the present invention is to provide a new and improved earthstone board game which is susceptible of a low cost of manufacture with regard to both materials and labor, and which accordingly is then susceptible of low prices of sale to the consuming public, thereby making such earthstone board games economically available to the buying public.

Still yet another object of the present invention is to provide a new and improved earthstone board game which provides in the apparatuses and methods of the prior art some of the advantages thereof, while simultaneously overcoming some of the disadvantages normally associated therewith.

Still another object of the present invention is to provide a new and improved earthstone board game to employ aspects of combat, the occult, and geographical simulated variances on a board game surface to effect a challenging game of a participant's wits and imagination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a top orthographic view of the board game of the instant invention illustrating the starting positions of the various tokens.

FIG. 9 is an orthographic top plan view of the board unit of the instant invention diagrammatically illustrating "Power Move Options" of the Archer and Wizard tokens of the instant invention.

FIG. 10 is a top orthographic plan view of the board game of the instant invention diagrammatically illustrating an example of movement of the Demon token of the instant invention.

DESCRIPTION OF THE PREFERRED EMBODIMENT

Figure 2:
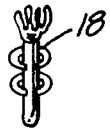
FIG. 2 is an orthographic illustration taken in elevation of the "Demon" player of the instant invention.
Figure 3:
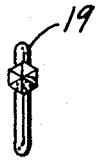
FIG. 3 is an orthographic illustration taken in elevation of the "Earthstone" of the instant invention.
Figure 4:
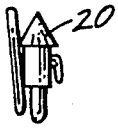
FIG. 4 is an orthographic illustration taken in elevation of the "Wizard" in the instant invention.
Figure 5:
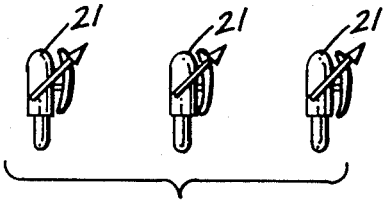
FIG. 5 is an orthographic illustration taken in elevation of the "Archers" utilized in the instant invention.
Figure 6:
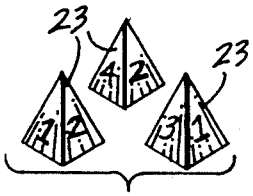
FIG. 6 is an isometric illustration of the dice utilized by the instant invention.
Figure 7:
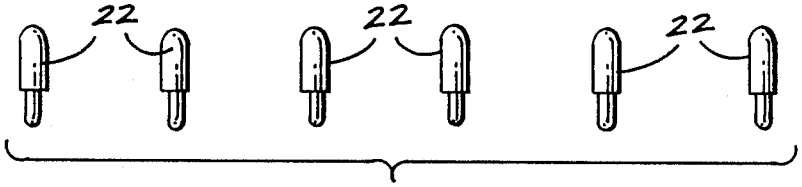
FIG. 7 is an orthographic illustration taken in elevation of the "Vassals" utilized in the instant invention.
Figure 1:
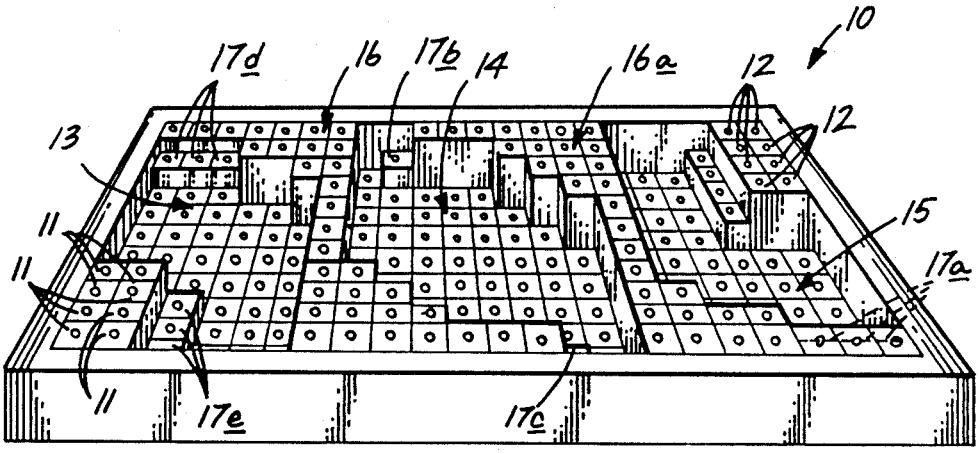
FIG. 1 is an isometric illustration of the board game surface of the instant invention.
Figure 1:
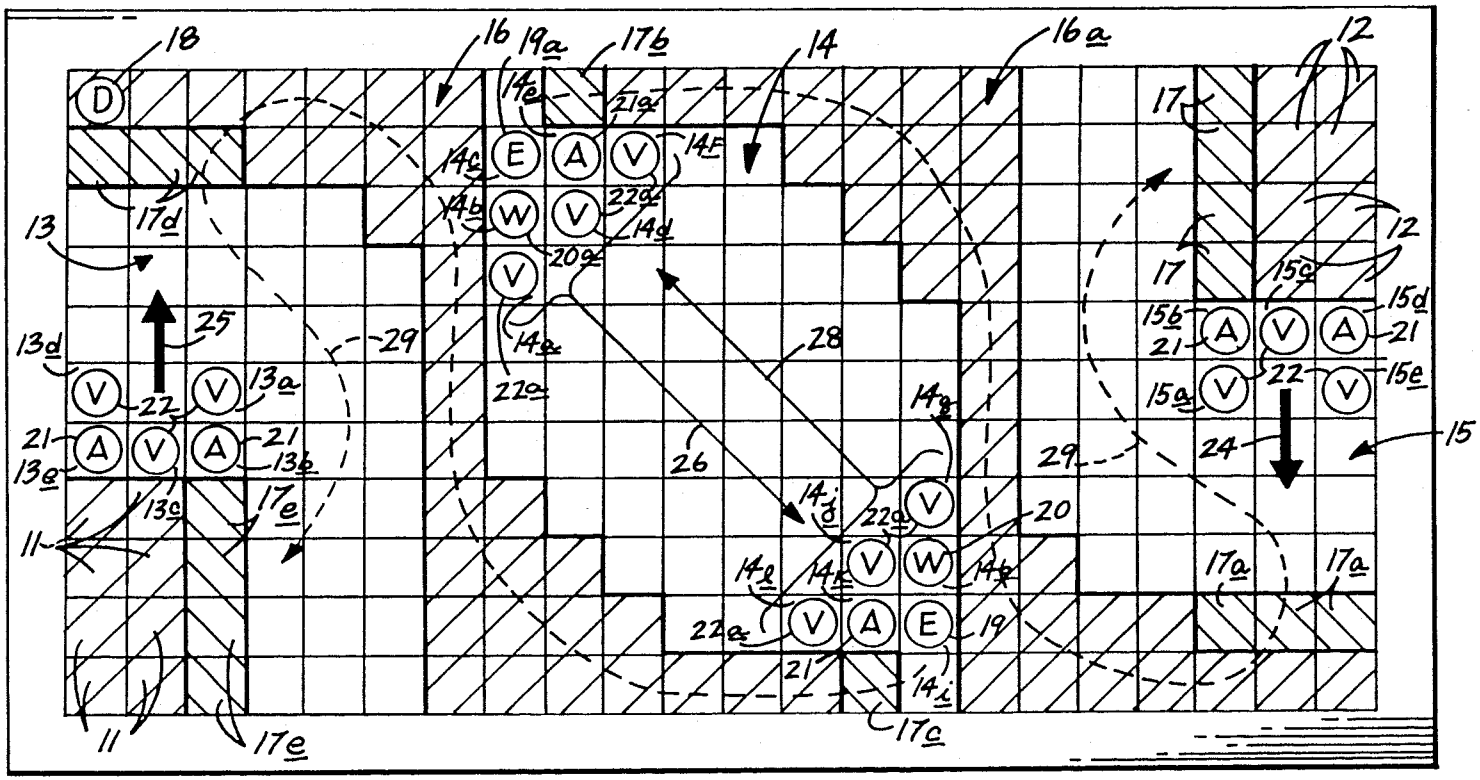
Figure 5:
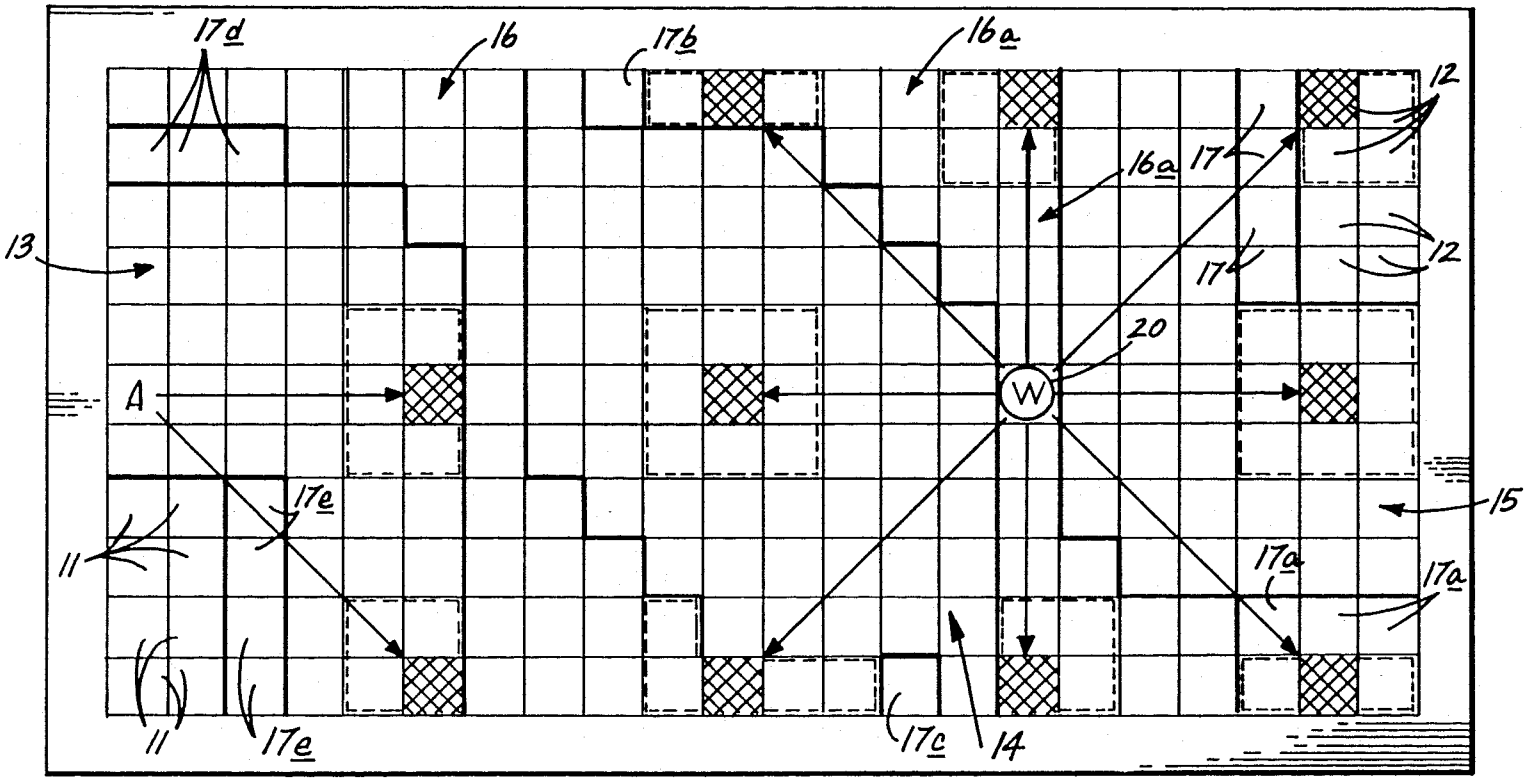
Figure 11:
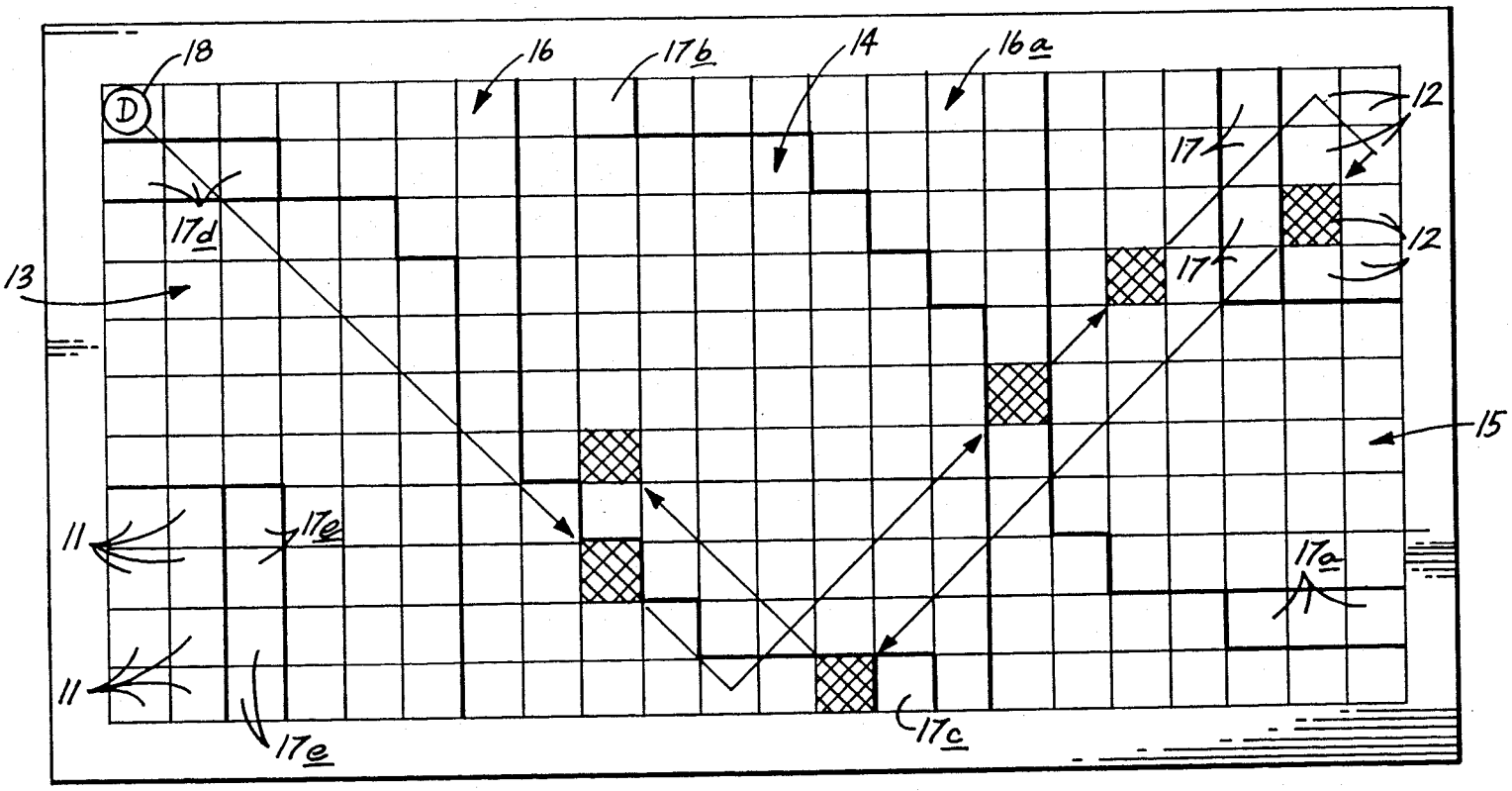

With reference now to the drawings, and in particular to FIGS. 1 through 10 thereof, a new and improved earthstone board game is set forth with reference to numeral 10 generally designating the game board of the invention.

More specifically, it will be noted that the earthstone board game essentially comprises a game board 10 of three dimensional configuration comprising a matrix of squares of varying depths including blind bores medially thereof to accept the lower peg or projection portion of the various tokens of the instant invention. The Home bases or "Keeps" are designated by a first Keep including six squares 11 of highest elevation positioned at a first corner of the perimeter framework of the game board with a second Keep defined by six squares of equal and highest elevation in the game board at an opposed corner of the perimeter framework of the game board.

The game board defines a first Keep valley 13, a second Keep valley 14 and a third Keep valley 15 wherein each valley includes a matrix of squares of lowermost elevation. It is to be noted that the valleys 13 and 15 are of equal but opposed configuration including a respective valley, and Keep separated by cliffs (or mountain range) and a second cliff matrix of squares **16*a* to define between the cliffs and second cliffs 16 and 16*a*, the second Keep valley 14 therebetween. The third cliff valley 15 of the second Keep 12 includes a first plateau series of squares 17 including four squares of equal extent of the first Keep squares 12 with a parallel sixth plateau series of spaces 17*e* adjacent the first Keep squares 11. A second plateau series of three spaces is positioned within the third Keep valley 15 as a transition zone adjacent the second cliffs 16*a* with a single square defining a third plateau space 17*b* terminating the matrix of second cliff 16 within the second Keep valley 14. It is to be understood that the plateau spaces 17 are required as transition steps from the Keeps and cliffs to the valley floor and or from the valley to the floor to the respective keep and cliff portions of the game board during movement of the tokens during playing of the game. Accordingly, a fourth plateau space 17*c* is provided as a transition and termination of the first cliffs 16 with a series of three plateau spaces defining a fifth series of plateau spaces 17*d* terminating the first cliffs 16 within the first valley 13**.

FIG. 2 illustrates diagrammatically the token set forth as the earthstone Demon 18. The Demon is positioned at the beginning of a game in the corner opposite the starting player's Keep wherein diagrammatically in FIG. 8, the Demon 18 designated is in alignment with the first Keep squares 11 along a narrow side of the rectangular framework defining the game board 10. From this spot, the Demon is moved as a third participant wherein by utilizing two of the pyramid dice or "bones" 23, the number 1, 2, 3, or 4 is presented face down on a rolling surface and these numbers are utilized wherein the sum of such two hypothetically attained numbers determines the movement or number of squares the Demon moves. The Demon moves only diagonally as diagrammatically illustrated in FIG. 10 such that upon reaching an inner interior surface of the perimeter framework of the game board, the Demon "deflects" at essentially a forty-five degree angle to the game board or a ninety degree angle to the incidents of the incoming path of the Demon relative to the deflected path, as illustrated in FIG. 10. The zig-zagging across the board continues and the Demon will traverse the game board regardless of terrain and may accordingly leap from the valley floors 13, 14, and 15 to the various plateau spaces 17, to the cliffs 16 and **16*a*. In the event that the Demon 18 enters diagonally into a corner, the Demon may at that juncture turn around and retrace his path in subsequent moves. Should the Demon token 18 land on any other token of either player, that token is removed from the game. The capture of the Earthstone tokens 19 are the objects of the game and accordingly are not immune to the Demon's presence, and if the Demon token 18 lands on a player's Earthstone token 19**, the opposing player immediately wins the game.

The earthstone token 19 is the prize token of each player and is to be guarded by each player above all the other tokens wherein the object of the game is to have a player pass from a starting position of the Home Keep valley either 13 or 15 and pass from that valley through the plateau squares entering the respective cliffs 16 and 16*a* along the cliffs and down through the second valley 14 through the terminating square or plateau across the intermediate second valley 14 and up through the opposing plateau square, be it 17*b* or 17*c*, along the cliffs into the opposing Keep valley and finally up the opposing player's plateau spaces 17 or 17*e* and wherein the earthstone 19 with one of the players must attain presence within the twelve squares comprising the opposing player's Keep, be it spaces 11 or 12, and the associated squares 17*e* or 17.

For example, the tokens associated with the squares 12 and 17 may be directed along first arrow 24 through the second plateau spaces 17 and through the second cliff squares 16*a* and along the direction of the arrow 26, descending onto the second valley floor squares by means of the third plateau space 17*b* then by means of the fourth plateau space 17*c* ascend the second cliff squares 16 and descend through the fifth plateau spaces 17*d* to the first Keep squares 11 in the direction of the arrow 27. Conversely, the tokens associated with the first Keep squares 11 may reverse this path, as directed by arrow 25, 28, and 29, as illustrated in FIG. 8.

The Wizard token 20 along with the Archer tokens 21 may direct power along any five squares in a straight line, or along any five squares diagonally. A power move therefore may only be made if its destination is within one square of an unprotected character, i.e. a character unprotected by the Vassal tokens 22. If a target character is protected by Vassal or the like within one square of that character, a power move may not be directed at that character. A further restriction in a power move is that the destination of the power move must be on the same level, i.e. cliff, plateau space or square, or valley square, or on a level lower than that of the character utilizing the power move. This means that an attacker at a cliff level, for example, may strike at characters on the cliffs, plateau squares, or on the valley squares. An attacker on the valley squares conversely may only strike at characters on the valley squares and may not direct a power move above that level. Of further note is that the Earthstone token and the Demon token are immune to all power moves and to reiterate, a power move must be able to strike an unprotected character to count as a turn. Understandably if the Wizard token strikes within one square of any unprotected character, it puts the opposing team in a status "spell" for two turns. While the enemy is in this "spell" it is frozen and may not attempt attacks of any kind. If the Archer provides a power move that strikes within one square of an unprotected character, that character is hit with an arrow and is removed from the playing field. The Vassal tokens 22 have no power move capabilities and are of a protective nature only.

GAME OBJECT

The object of the game is to utilize ten characters available to each player to simultaneously protect that player's castle or "Keep". There are four major characters, as discussed above, the Wizard, three Archers which employ special powers as described, and six minor characters or Vassals utilizing the tokens 20, 21, and 22 respectively, as set forth in FIGS. 4, 5, and 6. The Earthstone token 19 moves as if it is a separate character, but it cannot be attacked directly. The Earthstone is captured when the enemy kills all characters within one square of the Earthstone and places one of his own characters within one square of the Earthstone. The Demon wandering diagonally and randomly across the board, as set forth above, may land indiscriminately on any player whereupon that player is removed from the game board or upon the Demon token landing upon square occupied by the Earthstone will automatically win the game for the opposing player.

Point scores are awarded as follows:

1. Traverse the board with an Earthstone to the enemy Keep—10 points.
2. Remove or kill all of the opponents' characters—5 points.
3. Steal your opponent's Earthstone—5 points.
4. Demon lands on enemy Earthstone—2 points.

The Earthstone may be stolen by an enemy character who manages to move to a square adjacent to that occupied by an unprotected Earthstone of the opposing player wherein protection of the Earthstone token includes providing a member of the same team within one square of the Earthstone.

MOVEMENT OF CHARACTERS

With each turn, the players have the option of either, 1. moving three characters in an "L" pattern, i.e. two spaces in one direction, and one space orthogonally thereto, or 2. moving three characters one square each in any direction.

STARTING OF THE GAME

Initially the opposing tokens are situated, as illustrated in FIG. 8, wherein the opposing players position a plurality of Archers and Vassals in a "U" shaped pattern adjacent the respective Keep in a "U" shaped pattern wherein a "U" shaped and alternating pattern positions the Vassals utilizing the third Keep valley squares 15*a*, 15*b*, 15*c*, 15*d*, and 15*e* while the opposing Keep arranges alternative Vassals and Archers in a similar "U" shaped pattern of alternating Vassals and Archers adjacent the longitudinal end of the first Keep squares 11 and 17*e*. The first Keep player positions the remaining six tokens in a triangular formation in alignment with the forward three spaces of the Keep squares 11, as illustrated in FIG. 8, adjacent the fourth plateau space 17*c* wherein the Earthstone token 19 is positioned at the apex of the triangular formation and the Wizard token 20 adjacent thereto with an Archer token on the other side of the Earthstone token and a series of the remaining three Vassal tokens 22 forming the confronting face of the triangular formation opposing the opponent's players in the same formation. The Demon token is oriented, as discussed before, at an opposing corner of the Keep squares 11 position assuming the player of the Keep squares 11 is to proceed first wherein conversely it will be true that the Demon token would originate or start at a corner opposed to the Keep squares 12 should that player begun first. For example, the player of the first Keep 11 squares proceeds first and thereby moves his tokens utilizing three "L" shaped maneuvers or three single maneuvers and may at his option substitute a power move, as discussed, wherein a Wizard token or Archer token may strike in a five square radius utilizing a straight line or diagonal movement. The opposing player may then proceed on the same basis. The starting player may then move the Earthstone Demon according to the roll of two of the tokens 23 and in subsequent runs of play, players alternate moving the Demon token.

Play continues until either one player loses all of his tokens, one player's Earthstone token is stolen, as discussed, or one player reaches an opposing player's Keep with his Earthstone token and one other character token.

ANOTHER VERSION OF EARTHSTONE (GAMMONSTONE)

All of the rules are the same as in the Earthstone movement except three of the pyramidal dice 23 are thrown every turn to determine movements wherein three numbers appearing the same in a throw of the three dice 23 enables an additional turn wherein a rolling of a number 1 enables movement of one square in a straight direction, a roll of a number 2 enables two squares diagonally, and 3 enables two squares straight plus one square to the side in an "L" shaped maneuver. A roll of a number 4 allows four squares to be traversed diagonally. These movements are for each character, as in the normal course of play.

The manner of usage and operation therefore of the present invention should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A combat game for use by two players comprising, a game board including a three dimensional game board surface wherein said game board is defined by a rectangular perimeter, and said game board surface is divided into a first, second, and third valley section of a first geometrical height, and a first and second cliff section of a third geometrical height, and a plurality of plateau sections of a second geometrical height greater than the defined geometrical height of the valley sections and less than the defined geometrical height of the cliff sections wherein said plateau sections are positioned on said game board surface adjacent said cliff sections to permit game tokens traverse between said valley and said cliff sections and provide a step therebetween to permit such traverse, and a first castle section in the first valley section of a height equal to the third geometrical height with a plateau section adjacent thereto, and a second castle section in the third valley section of a height equal to the third geometrical height with a plateau section adjacent thereto, and each section comprising a matrix of squares of predetermined area wherein each square includes a bore to slidingly accept a single token of a plurality of tokens, and said plurality of tokens are of varying capabilities and positionable in said game board surface with an equal number of said tokens awarded each castle section and player, and a Demon token utilized alternatively by each player, and a plurality of pyramidal dice to determine movement of said Demon token.

2. A combat game as set forth in claim 1 wherein said first and second castle sections are positioned in opposed corners of said game board surface.

3. A combat game as set forth in claim 2 wherein each castle section comprises eight squares of a third geometrical height and wherein four squares define said plateau section adjacent said castle section.

4. A combat game as set forth in claim 3 wherein said plurality of tokens are divided into six Vassal tokens, three Archer tokens, one Wizard token, and an Earthstone token wherein each of said tokens are of different categories with each category defining predetermined power capabilities in traverse about said game board surface.

5. A combat game as set forth in claim 4 wherein said first and third valley sections are of equal configuration with said second valley section intermediate the first and third valley sections on said game board surface.

6. A combat game as set forth in claim 5 wherein said first and second cliff sections divide said first and third valley sections from said second valley section.

7. A combat game as set forth in claim 6 wherein initially the first and third valley sections contain five tokens and said second valley section contains twelve tokens divided equally between said opposing players.

* * * * *